US011484735B2

(12) United States Patent
Wilson

(10) Patent No.: US 11,484,735 B2
(45) Date of Patent: Nov. 1, 2022

(54) FALL PROTECTION CABLE SYSTEM FOR ROOFING INSTALLATION ON STEEL BUILDINGS AND METHOD OF USE AND INSTALLATION THEREOF

(71) Applicant: Jonathan Wade Wilson, Denver, CO (US)

(72) Inventor: Jonathan Wade Wilson, Denver, CO (US)

( * ) Notice: Subject to any disclaimer, the term of this patent is extended or adjusted under 35 U.S.C. 154(b) by 436 days.

(21) Appl. No.: 16/569,753

(22) Filed: Sep. 13, 2019

(65) Prior Publication Data

US 2020/0094085 A1 Mar. 26, 2020

Related U.S. Application Data

(60) Provisional application No. 62/735,718, filed on Sep. 24, 2018.

(51) Int. Cl.

| | |
|---|---|
| ***E04G 21/32*** | (2006.01) |
| ***A62B 35/00*** | (2006.01) |
| ***A62B 35/04*** | (2006.01) |

(52) U.S. Cl.

CPC ..... *A62B 35/0056* (2013.01); *A62B 35/0025* (2013.01); *A62B 35/0068* (2013.01); *A62B 35/0075* (2013.01); *A62B 35/04* (2013.01); *E04G 21/3223* (2013.01)

(58) Field of Classification Search

CPC . A62B 35/04; A62B 35/0056; A62B 35/0068; E04G 21/3223

See application file for complete search history.

(56) References Cited

U.S. PATENT DOCUMENTS

| | | | | |
|---|---|---|---|---|
| 1,661,930 A | | 3/1928 | Dietrich | |
| 3,237,717 A | * | 3/1966 | Jackson | E04D 13/12 182/45 |
| 3,880,405 A | | 4/1975 | Brueske | |
| 4,037,824 A | * | 7/1977 | Whitmer | A62B 35/0087 256/53 |
| 4,942,943 A | | 7/1990 | Flaherty | |
| 5,029,670 A | * | 7/1991 | Whitmer | E04G 21/3214 256/53 |
| 5,036,949 A | | 8/1991 | Crocker et al. | |
| 5,105,907 A | | 4/1992 | Lebow | |
| 5,287,944 A | | 2/1994 | Woodyard | |
| 5,307,897 A | * | 5/1994 | Turner | E04G 21/3261 182/113 |

(Continued)

*Primary Examiner* — Colleen M Chavchavadze

(74) *Attorney, Agent, or Firm* — Jeffrey C. Watson; Grell & Watson Patent Attorneys LLC

(57) ABSTRACT

A fall protection cable system configured for installation of a roof on a steel building includes a starting support post, a final support post, and a support cable. The starting support post is configured for attachment to a first side of the steel building and has a bottom starting end configured to attach to the first side of the steel building and a top starting end extending above the roof. The final support post is configured for attachment to a second side of the steel building and has a bottom final end configured to attach to the second side of the steel building and a top final end extending above the roof on the second side. The support cable is configured to be connected at an elevated position above the roof of the steel building between the top starting end and the top final end.

17 Claims, 10 Drawing Sheets

(56) References Cited

U.S. PATENT DOCUMENTS 5,358,068 A * 10/1994 Whitmer ..... A62B 35/04 182/113
5,377,958 A * 1/1995 Palmer ..... E04G 21/3223 256/64
5,409,195 A 4/1995 Strickland et al.
5,509,498 A 4/1996 Higaki et al.
5,522,472 A * 6/1996 Shuman, Jr. ..... A62B 35/0056 256/1
5,694,720 A 12/1997 Walcher et al.
5,730,246 A 3/1998 Beard
6,036,146 A * 3/2000 Paterson ..... E04G 21/3276 182/113
6,053,281 A * 4/2000 Murray ..... E04G 21/3223 248/237
6,112,853 A 9/2000 Beard
6,167,986 B1 * 1/2001 Calvillo ..... E04G 21/26 182/113
6,173,809 B1 * 1/2001 Cole ..... E04G 21/3276 182/3
6,270,057 B1 * 8/2001 Highley ..... E04G 21/3242 256/65.14
6,374,945 B1 4/2002 Sherwood
6,412,230 B1 * 7/2002 Zambelli ..... E04G 21/3295 52/27
6,412,598 B1 * 7/2002 Mackinnon ..... E04G 21/3261 182/4
6,478,111 B2 * 11/2002 Olson ..... A62B 35/0068 248/237
6,691,826 B1 * 2/2004 Dean ..... E04G 21/3295 182/113
6,715,238 B2 * 4/2004 Zambelli ..... A62B 35/0043 52/27
7,802,773 B2 * 9/2010 Murphy ..... E04G 21/3223 256/65.14
8,789,655 B2 7/2014 Dowie
10,287,786 B2 * 5/2019 Gurtler ..... A62B 35/0068
2004/0173405 A1 * 9/2004 Bove ..... E04G 21/329 182/3
2005/0098381 A1 5/2005 Flaherty
2005/0284693 A1 * 12/2005 Rhodes ..... E04G 21/3261 182/3
2006/0272891 A1 * 12/2006 Casebolt ..... A62B 35/0056 182/36
2006/0289233 A1 12/2006 Flaherty
2008/0035423 A1 * 2/2008 Meillet ..... A62B 35/0056 182/3
2009/0020363 A1 * 1/2009 Ingalls ..... E04G 5/001 182/113
2009/0095947 A1 * 4/2009 Supples ..... E04G 21/3219 256/64
2009/0223741 A1 * 9/2009 Picard, Jr. ..... E04G 21/3223 248/168
2014/0360809 A1 * 12/2014 Alguire ..... A62B 35/0056 182/36
2017/0028232 A1 * 2/2017 Watanabe ..... A62B 35/0068
2019/0143157 A1 * 5/2019 Jessop ..... A62B 35/0068 248/65
2019/0186158 A1 * 6/2019 Melic ..... G01L 5/24
2020/0261753 A1 * 8/2020 Lupi ..... A62B 35/0043
2022/0120101 A1 * 4/2022 Austin ..... A62B 35/0068

* cited by examiner

FALL PROTECTION CABLE SYSTEM FOR ROOFING INSTALLATION ON STEEL BUILDINGS AND METHOD OF USE AND INSTALLATION THEREOF

CROSS-REFERENCE TO RELATED APPLICATIONS

This application claims benefit of priority application, U.S. Provisional Ser. No. 62/735,718 filed Sep. 24, 2018 entitled "Fall Protection Cable System For Roofing Installation on Steel Buildings and Method of Use and Installation Thereof", which is incorporated herein by reference in its entirety.

FIELD OF THE DISCLOSURE

The present disclosure is directed to steel buildings and the construction thereof. More specifically, the present disclosure relates to a fall protection cable system for roofing installation on steel buildings and a method of use and installation thereof.

BACKGROUND

Generally speaking, a steel building is a metal structure fabricated with steel for the internal support and for exterior cladding, as opposed to steel framed buildings which generally use other materials for floors, walls, and external envelope. Steel buildings are used for a variety of purposes including storage, work spaces and living accommodation. They are classified into specific types depending on how they are used.

Steel provides several advantages over other building materials, such as wood. Steel is structurally sound and manufactured to strict specifications and tolerances. Any excess material is 100% recyclable. Steel does not easily warp, buckle, twist or bend, and is therefore easy to modify and offers design flexibility. Steel is also easy to install, is cost effective, and rarely fluctuates in price. Steel also allows for improved quality of construction and less maintenance, while offering improved safety and resistance. Furthermore, with the propagation of mold and mildew in residential buildings, using steel versus wood minimizes these infestations, as mold needs moist, porous material to grow and steel studs do not have those problems.

Some common types of steel buildings are "straight-walled" and "arch," or Nissen or Quonset hut. Further, the structural type may be classed as clear span or multiple spans. A clear span building does not have structural supports (e.g. columns) in the interior occupied space. Straight-walled, and arch type, refer to the outside shape of the building. More generally, these are both structural arch forms if they rely on a rigid frame structure. However, curved roof structures are typically associated with the arch term. Steel arch buildings may be cost efficient for specific applications. They are commonly used in the agricultural industry. Straight-walled buildings provide more usable space when compared to arch buildings. They are also easier to blend into existing architecture. Straight-walled buildings are commonly used for commercial, industrial, and many other occupancy types. Clear span refers to the internal construction. Clear span steel buildings utilize large overhead support beams, thus reducing the need for internal supporting columns. Clear span steel buildings tend to be less cost efficient than structures with interior columns. However, other practical considerations may influence the selection of framing style, such as occupancy, where interior structural obstructions are undesirable (e.g. aircraft hangars or sport arenas). Long Bay buildings are designed for use in bay spans of over 35'. They use prefabricated metal frames combined with conventional joists to provide larger openings and clearances in buildings.

There are five main types of structural components that make up a steel frame: tension members, compression members, bending members, combined force members and their connections. Tension members are usually found as web and chord members in trusses and open web steel joists. Ideally tension members carry tensile forces, or pulling forces, only and its end connections are assumed to be pinned. Pin connections prevent any moment (rotation) or shear forces from being applied to the member. Compression members are also considered as columns, struts, or posts. They are vertical members or web and chord members in trusses and joists that are in compression or being squished. Bending members are also known as beams, girders, joists, spandrels, purlins, lintels, and girts. Each of these members have their own structural application, but typically bending members will carry bending moments and shear forces as primary loads and axial forces and torsion as secondary loads. Combined force members are commonly known as beam-columns and are subjected to bending and axial compression. Connections are what bring the entire building together. They join these members together and must ensure that they function together as one unit.

One problem that has been discovered with the construction of steel buildings is the dangers associated with roofing or installation of the roofing panels on the steel building structure. During this process, the roof installers are positioned at elevated heights above the ground to install the roofing panels where they may be required to balance or hang over or on an edge, a beam, the like, etc. Although the roof installers may be required to be tied off during this roofing process, this is not practical during a lot of times of the roofing process, as this tying off process is difficult in certain locations and extremely time consuming. This difficulty in tying off leads to a significant risk of falling as the roof installers complete the installation of roofing panels which can lead to serious injury or even death. As such, there is clearly a need to provide a means or system that is easier and less time consuming to allow roof installers to be tied off during the entire roofing process.

The present disclosure may be designed to address at least certain aspects of the problems discussed above by providing a fall protection cable system for roofing installation on steel buildings and method of use and Installation thereof.

SUMMARY

In accordance with at least selected embodiments, the instant disclosure may address at least certain aspects of the above mentioned needs, issues and/or problems and may provide a fall protection cable system. The fall protection cable system may be configured for installation of a roof on a steel building. The fall protection cable system may generally include a starting support post, a final support post, and a support cable. The starting support post may be configured for attachment to a first side of the steel building. The starting support post may have a bottom starting end configured to attach to the first side of the steel building and a top starting end extending above the roof on the first side of the steel building. The final support post may be configured for attachment to a second side of the steel building. The final support post may have a bottom final end configured to attach to the second side of the steel building and a top final end extending above the roof on the second side of the steel building. The support cable may be configured to be connected at an elevated position above the roof of the steel building between the top starting end of the starting support post attached to the first side of the steel building and the top final end of the final support post attached to the second side of the steel building.

One feature of the disclosed fall protection cable system may be that the support cable can be configured for allowing a roofing installer to tie off to the support cable at the elevated position above the roof during installation of the roof.

In select embodiments of the disclosed fall protection cable system, the starting support post may include a starting horizontal member and a starting vertical member. The starting horizontal member may have a starting plate at one end configured for attachment to the steel building. The starting vertical member may be rigidly attached to the starting horizontal member and may extend upward therefrom. The starting vertical member may extend at a starting slightly obtuse angle from the end of the starting horizontal member with the starting plate. As a result, the starting vertical member may be oriented slightly past vertical from the end of the starting horizontal member with the starting plate.

In other select embodiments of the disclosed fall protection cable system, the final support post may include a final horizontal member and a final vertical member. The final horizontal member may have a final plate at one end configured for attachment to the steel building. The final vertical member may be rigidly attached to the final horizontal member and extend upward therefrom. The final vertical member may extend at a final slightly obtuse angle from the end of the final horizontal member with the final plate. As a result, the final vertical member may be oriented slightly past vertical from the end of the final horizontal member with the final plate.

Another feature of the disclosed fall protection cable system may be that a spring deflection can be created under a load of the support cable, like when a roofing installer falls. This spring deflection can be created by a combination of the starting vertical member and the final vertical member being oriented slightly past vertical from one another, wherein the starting vertical member and the final vertical member are configured to bend toward each other under the load of the support cable when the roofing installer falls.

In other select embodiments of the disclosed fall protection cable system, the starting vertical member may be a 2-piece starting vertical member. This 2-piece starting vertical member may have a base starting vertical member and a telescoping starting vertical member. The telescoping starting vertical member may be configured to be inserted into the base starting vertical member for use in the fall protection cable system. The telescoping starting vertical member may also be configured to be removed from the base starting vertical member, like for transportation of the starting support post.

In other select embodiments of the disclosed fall protection cable system, the final vertical member may be a 2-piece final vertical member. The 2-piece final vertical member may have a base final vertical member and a telescoping final vertical member. The telescoping final vertical member may be configured to be inserted into the base final vertical member for use in the fall protection cable system. The telescoping final member may also be configured to be removed from the base final vertical member, like for transportation of the final support post.

In other select embodiments of the disclosed fall protection cable system, the starting support post may further include a starting ground anchor. The starting ground anchor may be connected from an another end of the starting horizontal member to ground via a starting concrete anchor plate affixed thereto. In select embodiments, the starting ground anchor may be connected to the another end of the starting horizontal member via a first eyebolt. In other select embodiments, the starting ground anchor may be connected to the starting concrete anchor via a starting turnbuckle cable connection. This starting turnbuckle cable connection may be configured for tensioning the starting ground anchor between the another end of the starting horizontal member and the ground.

In other select embodiments of the disclosed fall protection cable system, the final support post may further include a final ground anchor. The final ground anchor may be connected from an another end of the final horizontal member to ground via a final concrete anchor plate affixed thereto. In select embodiments, the final ground anchor may be connected to the another end of the final horizontal member via a third eyebolt. In other select embodiments, the final ground anchor may be connected to the final concrete anchor via a final turnbuckle cable connection. This final turnbuckle cable connection may be configured for tensioning the final ground anchor between the another end of the final horizontal member and the ground.

In other select embodiments of the disclosed fall protection cable system, the starting support post may further include a starting angled support member. The starting angled support member may be rigidly connect between the starting vertical member at a first support location and the starting horizontal member at the another end of the starting horizontal member opposite of the starting plate. The starting angled support member may be configured to support the starting vertical member under load of the support cable.

In other select embodiments of the disclosed fall protection cable system, the final support post may further include a final angled support member. The final angled support member may be rigidly connect between the final vertical member at a second support location and the final horizontal member at the another end of the final horizontal member opposite of the final plate. The final angled support member may be configured to support the final vertical member under load of the support cable.

In other select embodiments of the disclosed fall protection cable system, the starting support post may further include a cable winch, a pulley and a chain. The cable winch may be positioned on the starting angle support and connected to a first end of the support cable. The cable winch may be configured for creating a desired tension in the support cable between the starting support post and the final support post. The pulley may be at the top starting end of the starting support post configured to position the support cable at the top starting end of the starting support post while allowing the support cable to roll over the top starting end of the starting support post while being tensioned by the winch. The chain may be configured to connect the first end of the support cable to the another end of the starting horizontal member. This chain connection may be for removing the cable winch from the forces of the support cable. The chain may include an S-link at one end for removable connection to the first end of the support member. The chain may also be connected to the another end of the starting horizontal member via a second eyebolt.

In other select embodiments of the disclosed fall protection cable system, the final support post may further include a fourth eyebolt attached to the top final end of the final support post. The fourth eyebolt may be configured to connect to a second end of the support cable for fixing the support cable to the top final end of the final support post.

In other select embodiments of the disclosed fall protection cable system, the final support post may further include an optional shock absorber. The shock absorber may be connected between the fourth eyebolt and the second end of the support cable. The shock absorber may be configured to absorb the shock created in the support cable when under the load in the support cable from the roofing installer falling.

In select embodiments of the disclosed fall protection cable system, the starting support post and the final support post may be constructed from hollow structural section steel posts. The hollow structural section steel posts of the starting support post and the final support post may have, but are not limited to, a width of 2.5", a depth of 2.5", and a thickness of ¼".

Another feature of the disclosed fall protection cable system may be that the starting support post and the final support post may be configured to position the support cable at the elevated position above the roof, including but not limited to, an elevated position of approximately 8 feet.

In select embodiments of the disclosed fall protection cable system, the system may further include at least one intermediate support post. The at least one intermediate support post may be positioned between the starting support post and the final support post. Each of the at least one intermediate support posts may include a base and a summit. The base may be configured to be positioned on the roof of the steel building at one end of the intermediate support post. The summit at the other end of the intermediate support post may be positioned at or approximate to the elevated position of the support cable. A passage at the summit of the intermediate support post may be configured for receiving the support cable therethrough. The passage may support the support cable at the elevated position above the roof at a support location of the intermediate support post. The support location of each of the at least one intermediate support posts may be positioned a set distance between the starting support post and the final support post. In select embodiments, the set distance may be, but is not limited to, between 50 feet and 150 feet.

In select embodiments of the disclosed fall protection cable system, the base of each of the intermediate support posts may be either a rigid base or a panel base. The rigid base may be configured to attach the intermediate support post directly to a roof beam of the steel building. The panel base may be configured to attach the intermediate support post on top of a roof panel already installed on the steel building. Wherein, the intermediate support posts may be configured to be changed from the rigid base to the panel base once the roof panel is installed on the steel building at the location of the intermediate support post. In select embodiments, the rigid base may include a bracket configured for bolting the base to the roof beam. In other select embodiments, the panel base of the intermediate support post may include an I-shaped beam with a center beam and two outer beams. The center beam may be rigidly connected to the base of the intermediate support post. The two outer beams may include channels configured to be inserted over standing seams of adjoining roof panels, where the two outer beams are configured to be rigidly attached to the standing seam of adjoining roof panels. The I-shaped beam may be adjustable from 16" to 24" roofing panels.

Another feature of the disclosed fall protection cable system may be the inclusion of personal protective equipment. The personal protective equipment may be configured for tying off the roofing installer to the support cable. In select embodiments, the personal protective equipment may include, but is not limited to, a harness, a lanyard, and a retractable lanyard.

In another aspect, the instant disclosure embraces the fall protection cable system configured for installation of a roof on a steel building in any of the various embodiments shown and/or described herein. In select embodiments, the disclosed fall protection cable system may include various combinations of the embodiments shown and/or described herein including, but not limited to, a combination of all of the various embodiment of the fall protection cable system shown and/or described herein.

In another aspect, the instant disclosure a method of installing a roof on a steel building with a fall protection cable system. In general, the disclosed method of installing a roof on a steel building includes utilizing the fall protection cable system in any of the various embodiments shown and/or described herein. Accordingly, in select embodiments, the method of installing a roof on a steel building includes providing the fall protection cable system in any of the various embodiments shown and/or described herein, including: a starting support post configured for attachment of a first side of the steel building, said starting support post having a bottom starting end configured to attach to the first side of the steel building and a top starting end extending above the roof on the first side of the steel building; a final support post configured for attachment to a second side of the steel building, said final support post having a bottom final end configured to attach to the second side of the steel building and a top final end extending above the roof on the second side of the steel building; a support cable configured to be connected at an elevated position above the roof of the steel building between the top starting end of the starting support post attached to the first side of the steel building and the top final end of the final support post attached to the second side of the steel building; and personal protective equipment configured for tying off the roofing installer to the support cable, the personal protective equipment including: a harness; a lanyard; and a retractable lanyard. The method of installing a roof on a steel building thus includes: attaching the starting support post to the first side of the steel building; attaching the final support post to the second side of the steel building; tensioning the support cable between the top starting end of the starting support post attached to the first side of the steel building and the top final end of the final support post attached to the second side of the steel building; and tying off a roof installer to the support cable via the personal protective equipment.

In select embodiments of the disclosed method of installing a roof on a steel building, wherein the fall protection cable system may further include an intermediate support post, the method may further include: attaching the intermediate support post to a roof beam at a set distance between the starting support post and the final support post; and supporting the support cable with the intermediate support post at the set distance between the starting support post and the final support post by inserting the support cable in a passage at a summit of the intermediate support post.

The foregoing illustrative summary, as well as other exemplary objectives and/or advantages of the disclosure, and the manner in which the same are accomplished, are further explained within the following detailed description and its accompanying drawings.

BRIEF DESCRIPTION OF THE DRAWINGS

The present disclosure will be better understood by reading the Detailed Description with reference to the accompanying drawings, which are not necessarily drawn to scale, and in which like reference numerals denote similar structure and refer to like elements throughout, and in which.

Figure 1:
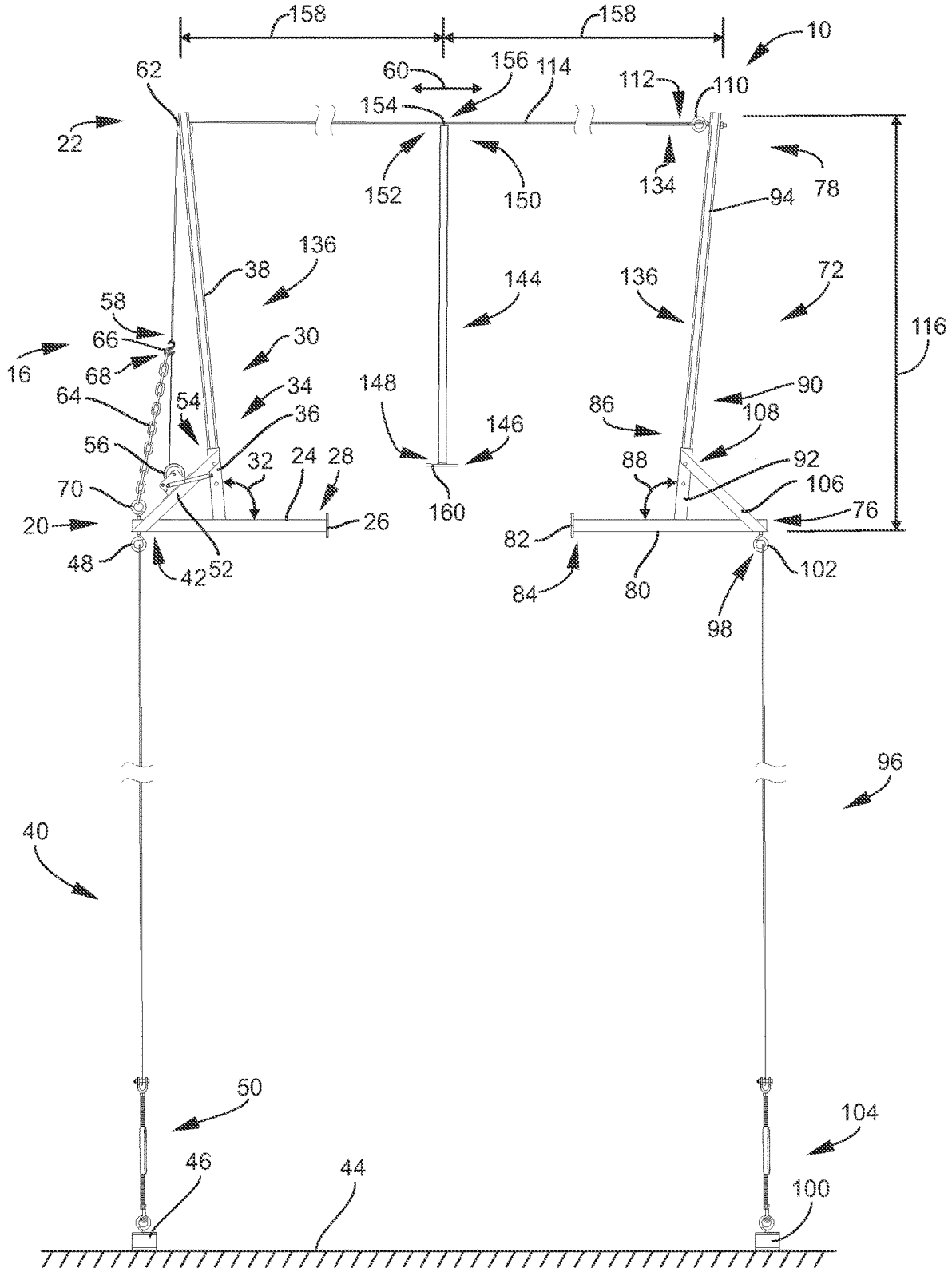
FIG. 1 is a front view of the fall protection cable system for roofing installation on steel buildings according to select embodiments of the instant disclosure.

It is to be noted that the drawings presented are intended solely for the purpose of illustration and that they are, therefore, neither desired nor intended to limit the disclosure to any or all of the exact details of construction shown, except insofar as they may be deemed essential to the claimed disclosure.

DETAILED DESCRIPTION

Referring now to FIGS. 1-10, in describing the exemplary embodiments of the present disclosure, specific terminology is employed for the sake of clarity. The present disclosure, however, is not intended to be limited to the specific terminology so selected, and it is to be understood that each specific element includes all technical equivalents that operate in a similar manner to accomplish similar functions. Embodiments of the claims may, however, be embodied in many different forms and should not be construed to be limited to the embodiments set forth herein. The examples set forth herein are non-limiting examples, and are merely examples among other possible examples.

Referring now to FIGS. 1-9, in a possibly preferred embodiment, the present disclosure overcomes the above-mentioned disadvantages and meets the recognized need for such an apparatus or method by providing of fall protection cable system 10 for installing roof 12 on steel building 14, or the like. This fall protection cable system 10 may be used for roof installation purposes on any type of buildings, including, but not limited to the steel buildings, or the like, as shown in FIGS. 5-8. Fall protection cable system 10 for installing roof 12 of steel building 14, and method of use and installation thereof, may generally include starting support post 16, final support post 72, and support cable 114. These parts and their functions are described in greater detail below.

Figure 2:
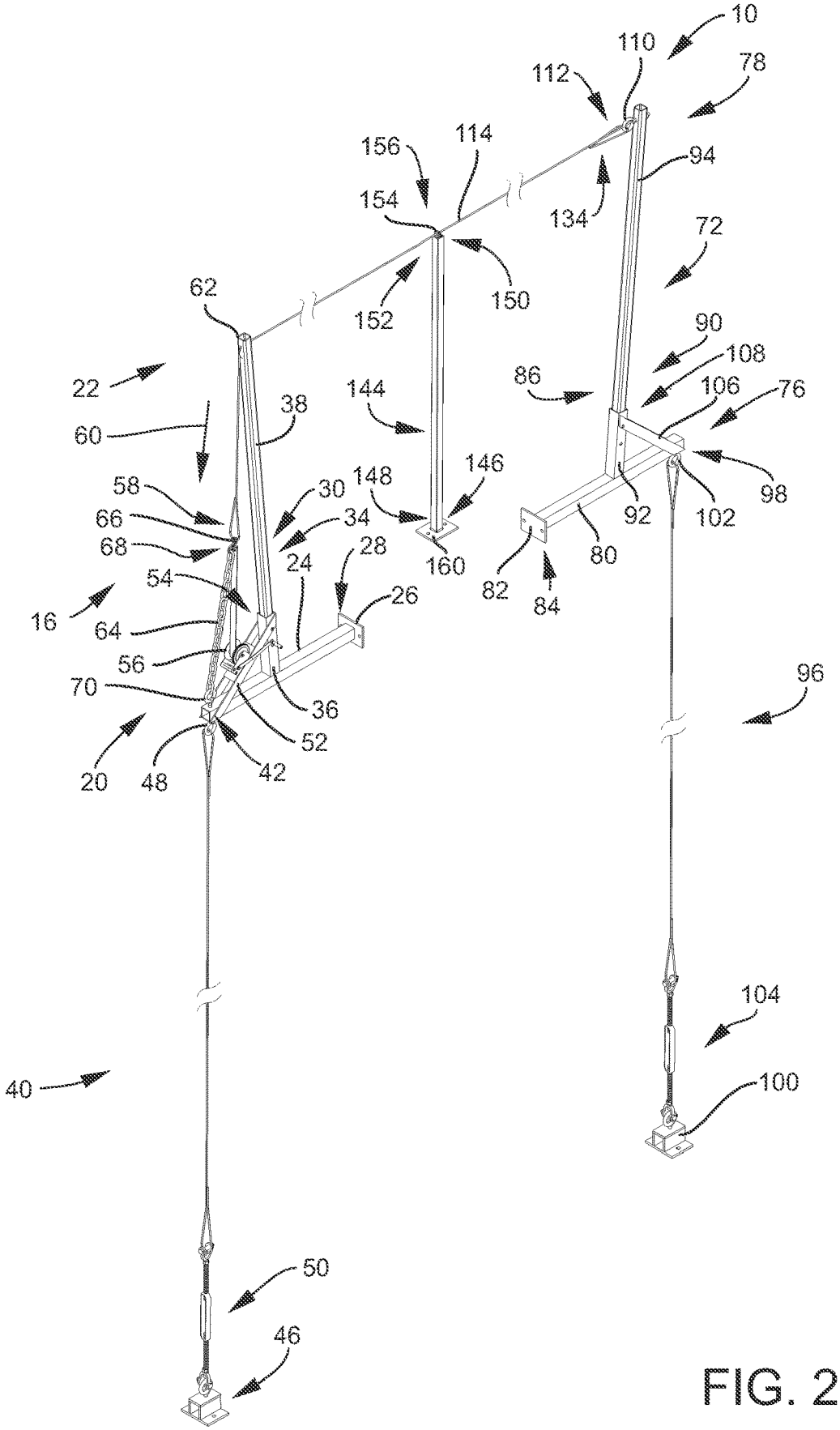
FIG. 2 is a perspective side view of the fall protection cable system for roofing installation on steel buildings from FIG. 1.
Figure 3:
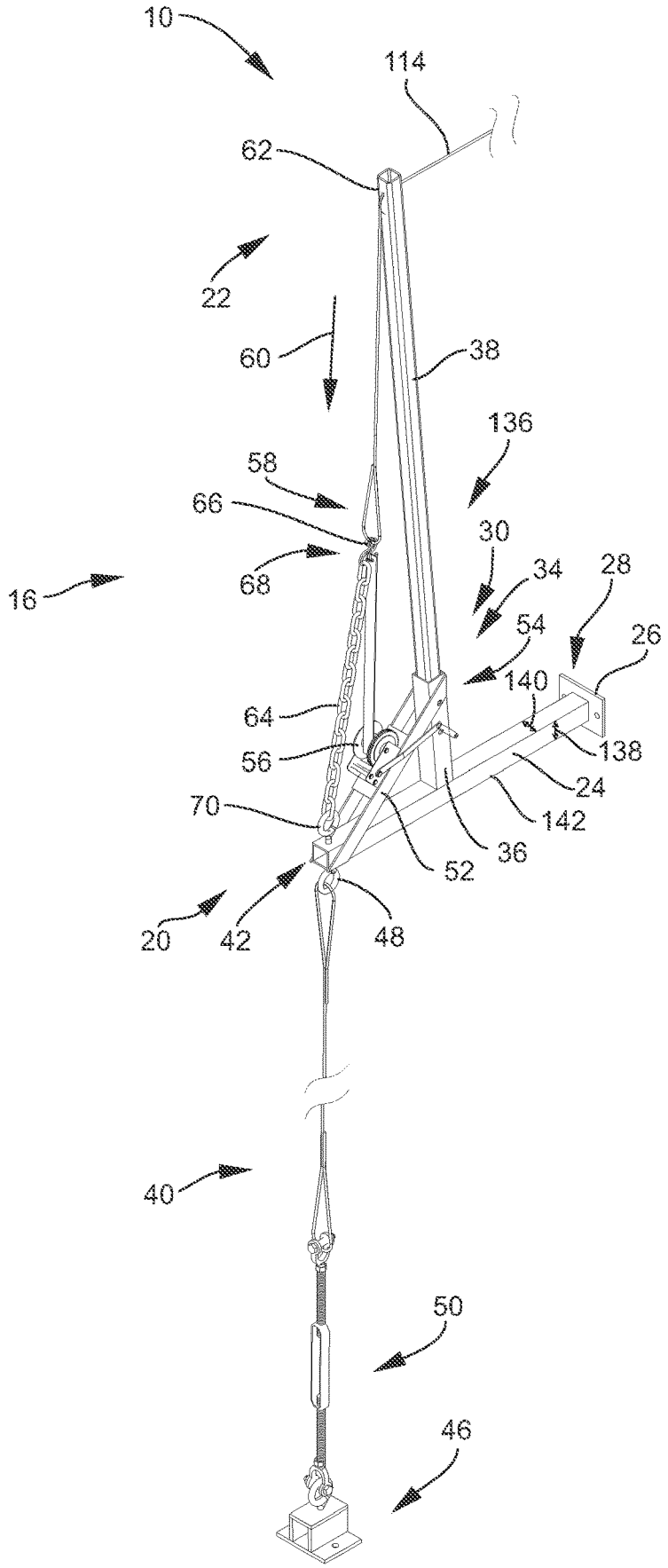
FIG. 3 is a zoomed in side perspective view of the starting support post of the fall protection cable system for roofing installation on steel buildings from FIG. 1.
Figure 5:
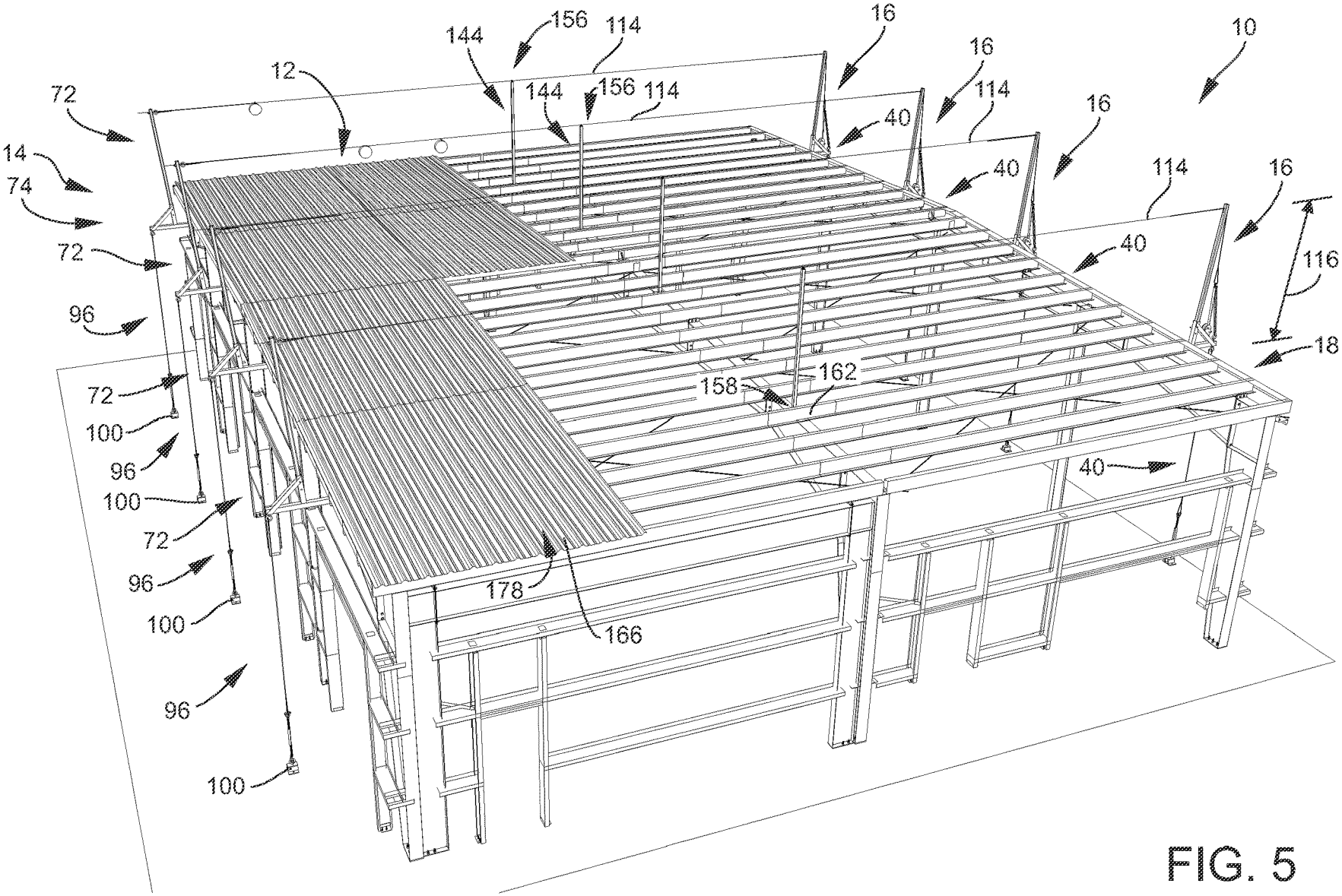
FIG. 5 is an environmental perspective view of the fall protection cable system for roofing installation on steel buildings according to select embodiments of the instant disclosure installed on a steel building.
Figure 6:
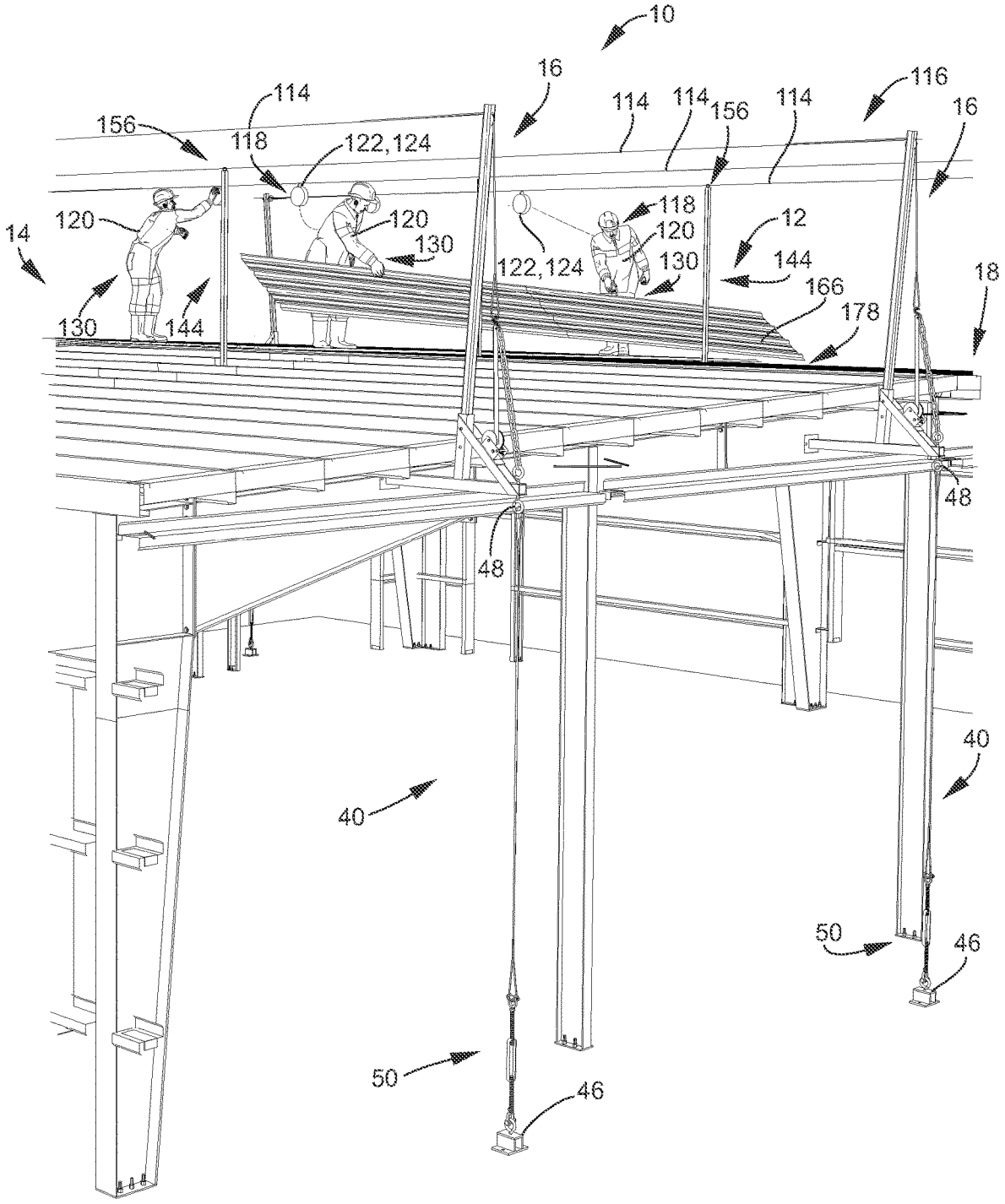
FIG. 6 is an environmental perspective side view of the starting support posts of the fall protection cable system for roofing installation on steel buildings according to select embodiments of the instant disclosure installed on a steel building in use with user's tied off while installing roofing.

Starting support post 16 may be included in fall protection cable system 10. Starting support post 16 may be for providing a structure on one side of steel building 14 for supporting support cable 114 at elevated position 116 above roof 12. Starting support post 16 may include any members, devices or mechanisms for supporting support cable 114 at elevated position 116 above roof 12 on first side 18 of steel building 14. Starting support post 16 may also be for providing a means for tightening support cable 114 to desired tension 60. Starting support post 16 may be configured for attachment to first side 18 of steel building 14, as shown in FIGS. 5 and 6. Starting support post 16 may be connected or attached to first side 18 of steel building 14 by any mean, including any plates, brackets, welds, holes, screws, adhesives, the like, etc. As shown in FIGS. 1-3, starting support post 16 may have bottom starting end 20 configured to attach to first side 18 of steel building 14 and top starting end 22 extending above roof 12 on first side 18 of steel building 14.

As shown in detail in FIGS. 1-3, in select embodiments, starting support post 16 may include starting horizontal member 24 and starting vertical member 30. Starting horizontal member 24 may have starting plate 26 at one end 28 configured for attachment to steel building 14. Starting plate 26 may be a welded flat service on one end 28 of starting horizontal member 24. Starting plate 26 may include pre-drilled holes configured for attaching starting support post 16 to first side 18 of steel building 14. As an example, a magnetic drill may be utilized for drilling holes through first side 18 of steel building 14 at the locations for pre-drilled holes in starting plate 26, whereby bolts may be used to secure starting plate 26 to first side 18 of steel building 14. Starting vertical member 30 may be rigidly attached to starting horizontal member 24 and may extend upward therefrom. As shown in the Figures, starting vertical member 30 may be attached near the center of starting horizontal member 24 for creating an upside down T-shaped configuration. As shown in FIG. 1, starting vertical member 30 may extend at starting slightly obtuse angle 32 from end 28 of starting horizontal member 24 with starting plate 26. As a result, starting vertical member 30 may be oriented slightly past vertical from end 28 of starting horizontal member 24 with starting plate 26. As will be explained below, and shown in FIGS. 8-9, this orientation of starting vertical member 30 allows for spring deflection 126 of starting vertical member 30 when load 128 of falling roofing installer 130 is put on support cable 114.

Still referring to the details of starting support post 16 shown in FIGS. 1-3, in select embodiments starting vertical member 30 may be 2-piece starting vertical member 34. 2-piece starting vertical member 34 may have base starting vertical member 36 and telescoping starting vertical member 38. Telescoping starting vertical member 38 may be configured to be inserted or slid into base starting vertical member 36, as in a telescopic manner, for use in fall protection cable system 10. Telescoping starting vertical member 38 may also be configured to be removed or slid out from base starting vertical member 36, like for transportation of starting support post 16.

Still referring to the details shown in FIGS. 1-3 of starting support post 16, and also shown in FIGS. 5-6, in select embodiments starting support post 16 may further include starting ground anchor 40. Starting ground anchor 40 may be for providing extra support to starting support post 16 from rotating about first side 18 of steel building 14, like during tensioning of support cable 114 or during an experienced load 128 on support cable 114 of falling roofing installer 130. Starting ground anchor 40 may be connected from another end 42 of starting horizontal member 24 to ground 44 via starting concrete anchor plate 46 affixed thereto, as shown in FIG. 1. In select embodiments, starting ground anchor 40 may be connected to another end 42 of starting horizontal member 24 via first eyebolt 48, or the like. In other select embodiments, starting ground anchor 40 may be connected to starting concrete anchor plate 46 via starting turnbuckle cable connection 50. Starting turnbuckle cable connection 50 may be configured for tensioning starting ground anchor 40 between another end 42 of starting horizontal member 24 and ground 44. As an example, and clearly not limited thereto, the starting concrete anchor plate 46 may be a ¼" thick plate anchored with (2)½" Tapcon concrete screw anchors, where each starting ground anchor 40 may have pullout strength of 8,550 pounds.

Still referring to the details shown in FIGS. 1-3 of starting support post 16, in other select embodiments, starting support post 16 may further include starting angled support member 52. Starting angle support member 52 may be for supporting starting vertical member 30 in its upright position at starting slightly obtuse angle 32. Starting angled support member 52 may be rigidly connected between starting vertical member 30 at first support location 54 and starting horizontal member 24 at another end 42 of starting horizontal member 24 opposite of starting plate 26. As a result, starting angled support member 52 may be configured to support starting vertical member 30 under load 128 of support cable 114.

Still referring to the details shown in FIGS. 1-3 of starting support post 16, in other select embodiments, starting support post 16 may further include cable winch 56, pulley 62 and chain 64. Cable winch 56 may be any winch type of device or the like. Cable winch 56 may be positioned anywhere on starting support post 16, including, but not limited to, on starting angle support member 52, as shown in the Figures. Cable winch 56 may be connected to first end 58 of support cable 114. Cable winch 56 may be configured for creating desired tension 60 in support cable 114 between starting support post 16 and final support post 72. Pulley 62 may be at top starting end 22 of starting support post 16. Pulley 62 may be configured to position support cable 114 at top starting end 22 of starting support post 16 while allowing support cable 114 to move or roll over top starting end 22 of starting support post 16, like while being tensioned by cable winch 56. Chain 64 may be configured to connect first end 58 of support cable 114 to another end 42 of starting horizontal member 24. Chain 64 may thus provide a connection for removing cable winch 56 from any forces on support cable 114. Chain 64 may include S-link 66 at one end 68 for removable connection to first end 58 of support cable 114. Chain 64 may also be connected to another end 42 of starting horizontal member 24 via second eyebolt 70. In use, cable winch 56 may be used to tighten support cable 114 to desired tension 60. To add chain 64 and remove cable winch 56 from support cable 114, cable winch 56 may tighten support cable 114 slightly passed desired tension 60. Then chain 64 can be connected and cable winch 56 may be released and removed from first end 58 of support cable 114.

Figure 4:
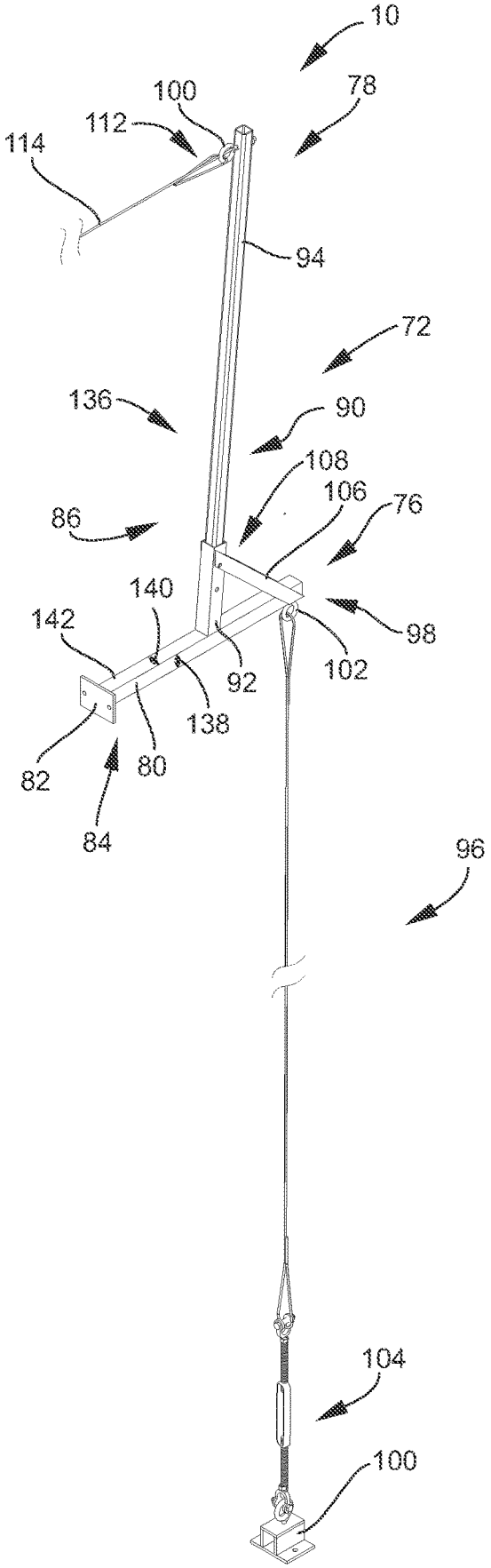
FIG. 4 is a zoomed in side perspective view of the final support post of the fall protection cable system for roofing installation on steel buildings from FIG. 1.
Figure 7:
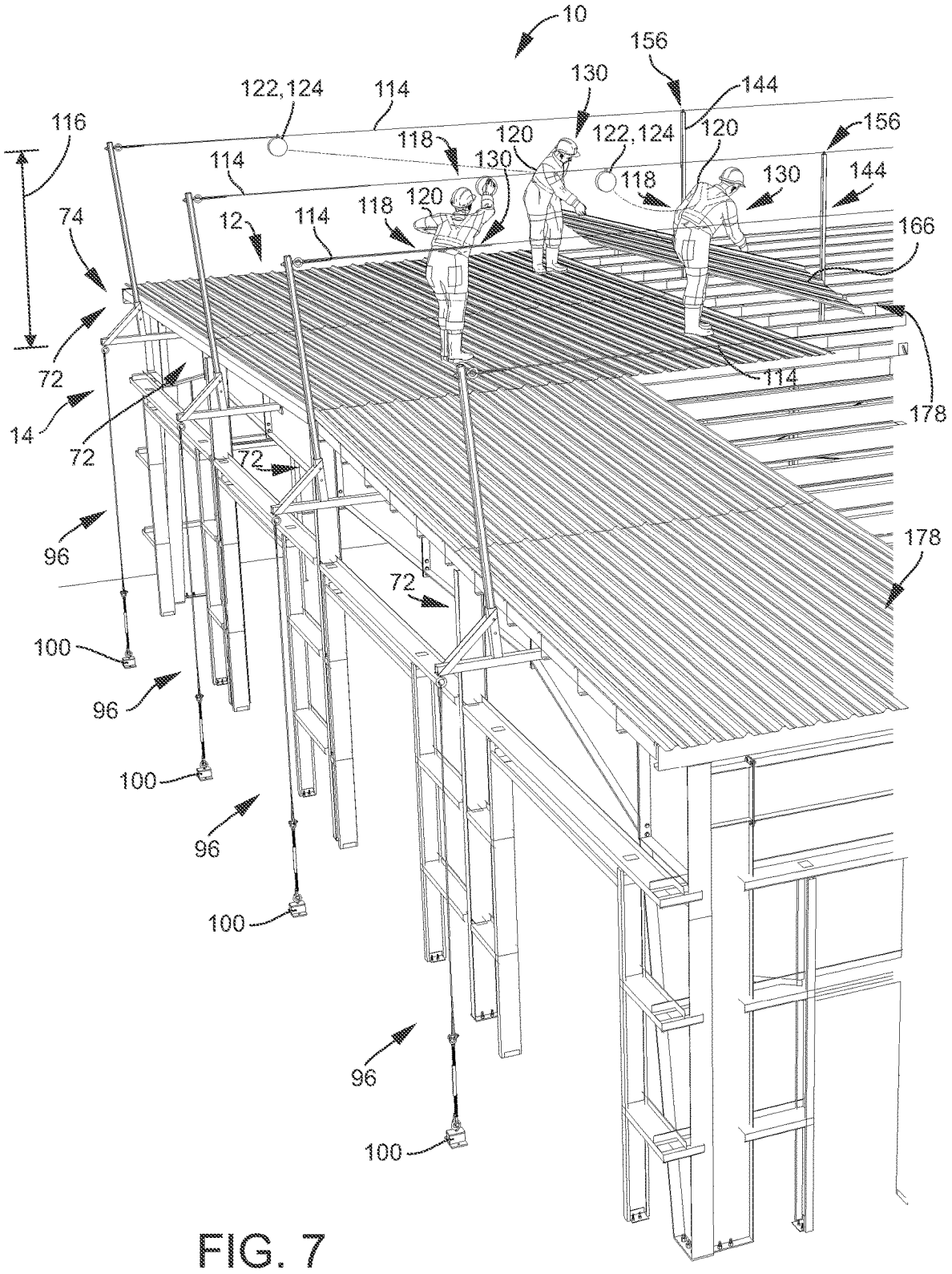
FIG. 7 is an environmental perspective side view of the final support posts of the fall protection cable system for roofing installation on steel buildings according to select embodiments of the instant disclosure installed on a steel building in use with user's tied off while installing roofing.

Final support post 72 may be included in fall protection cable system 10. Final support post 72 may be for providing a structure the opposite side of steel building 14 as starting support post 16 for supporting support cable 114 at elevated position 116 above roof 12. Final support post 72 may include any members, devices or mechanisms for supporting support cable 114 at elevated position 116 above roof 12 on second side 74 of steel building 14. Final support post 72 may be configured for attachment to second side 74 of steel building 14, as shown in FIGS. 5 and 7. Final support post 72 may be connected or attached to second side 74 of steel building 14 by any mean, including any plates, brackets, welds, holes, screws, adhesives, the like, etc. As shown in FIGS. 1-2 and 4, final support post 72 may have bottom final end 76 configured to attach to second side 74 of steel building 14 and top final end 78 extending above roof 12 on second side 74 of steel building 14.

As shown in detail in FIGS. 1-2 and 4, in select embodiments, final support post 72 may include final horizontal member 80 and final vertical member 86. Final horizontal member 80 may have final plate 82 at one end 84. Final plate 82 may be configured for attachment to steel building 14. Final plate 82 may be a welded flat service on one end 84 of final horizontal member 80. Final plate 82 may include pre-drilled holes configured for attaching final support post 72 to second side 74 of steel building 14. As an example, a magnetic drill may be utilized for drilling holes through second side 74 of steel building 14 at the locations for pre-drilled holes in final plate 82, whereby bolts may be used to secure final plate 82 to second side 74 of steel building 14. Final vertical member 86 may be rigidly attached to final horizontal member 80 and extend upward therefrom. As shown in the Figures, final vertical member 86 may be attached near the center of final horizontal member 80 for creating an upside down T-shaped configuration. As shown in FIG. 1, final vertical member 86 may extend at final slightly obtuse angle 88 from end 84 of final horizontal member 80 with final plate 82. As a result, final vertical member 86 may be oriented slightly past vertical from end 84 of final horizontal member 80 with final plate 82. As will be explained below, and shown in FIGS. 8-9, this orientation of final vertical member 86 allows for spring deflection 126 of final vertical member 86 when load 128 of falling roofing installer 130 is put on support cable 114.

Still referring to the details of final support post 72 shown in FIGS. 1-2 and 4, in select embodiments final vertical member 86 may be 2-piece final vertical member 90. 2-piece final vertical member 90 may have base final vertical member 92 and telescoping final vertical member 94. Telescoping final vertical member 94 may be configured to be inserted into base final vertical member 92, as in a telescopic manner, for use in fall protection cable system 10. Telescoping final vertical member 94 may also be configured to be removed or slid out from base final vertical member 92, like for transportation of final support post 72.

Still referring to the details of final support post 72 shown in FIGS. 1-2 and 4, and also shown in FIGS. 5 and 7, in select embodiments final support post 72 may further include final ground anchor 96. Final ground anchor 96 may be for providing extra support to final support post 72 from rotating about second side 74 of steel building 14, like during tensioning of support cable 114 or during an experienced load 128 on support cable 114 of falling roofing installer 130. Final ground anchor 96 may be connected from another end 98 of final horizontal member 80 to ground 44 via final concrete anchor plate 100 affixed thereto, as shown in FIG. 1. In select embodiments, final ground anchor 96 may be connected to another end 98 of final horizontal member 80 via third eyebolt 102. In other select embodiments, final ground anchor 96 may be connected to final concrete anchor plate 100 via final turnbuckle cable connection 104. Final turnbuckle cable connection 104 may be configured for tensioning final ground anchor 96 between another end 98 of final horizontal member 80 and ground 44. As an example, and clearly not limited thereto, the final concrete anchor plate 100 may be a ¼" thick plate anchored with (2)½" Tapcon concrete screw anchors, where each final ground anchor 96 may have pullout strength of 8,550 pounds.

Still referring to the details shown in FIGS. 1-2 and 4 of final support post 72, in other select embodiments, final support post 72 may further include final angled support member 106. Final angled support member 106 may be for supporting final vertical member 86 in its upright position at final slightly obtuse angle 88. Final angled support member 106 may be rigidly connect between final vertical member 86 at second support location 108 and final horizontal member 80 at another end 98 of final horizontal member 80 opposite of final plate 82. Final angled support member 106 may be configured to support final vertical member 86 under load 128 of support cable 114.

Still referring to the details shown in FIGS. 1-2 and 4 of final support post 72, in other select embodiments, final support post 72 may further include fourth eyebolt 110 attached to top final end 78 of final support post 72. Fourth eyebolt 110 may be configured to connect to second end 112 of support cable 114 for fixing support cable 114 to top final end 78 of final support post 72. However, as with the case with all of the eyebolts disclosed herein (first eyebolt 48, second eyebolt 70, third eyebolt 102 and fourth eyebolt 110) the disclosure is not so limited to use of eyebolts, and any other attachment means for cables, chains, the like, etc. may be utilized in fall protection cable system 10.

Still referring to the details shown in FIGS. 1-2 and 4 of final support post 72, in other select embodiments, final support post 72 I may further include optional shock absorber 134. Shock absorber 134 may be connected anywhere in support cable 114. As shown in the Figures, in select embodiments, Shock absorber 134 may be connected between fourth eyebolt 110 and second end 112 of support cable 114. Shock absorber 134 may be configured to absorb the shock created in support cable 114 when under load 128 in support cable 114 from roofing installer 130 falling. In select embodiments, shock absorber 134 on final support post 72 may be, but is not limited to, a Zorbit™ energy absorber, or the like, provide by 3M of Minneapolis, Minn.

Starting support post 16 and final support post 72 may be constructed from various desired materials to handle load 128 of roofing installer 130 falling while tied off to support cable 114. In select embodiments, starting support post 16 and final support post 72 may be made from hollow structural section steel posts 136. For examples, and clearly not limited thereto, in select embodiments, hollow structural section steel posts 136 of starting support post 15 and final support post 72 may have, but are not limited to, width 138 of 2.5" or approximate thereto, depth 140 of 2.5" or approximate thereto, and/or thickness 142 of ¼" or approximate thereto. As an example, and clearly not limited thereto, starting support post 16 and final support post 72 may be HSS 3×3×3/16. Starting support post 16 may be attached to rafters of steel building 14 using (2) ¾" bolts through starting plate 26 and final plate 82, which may provide a 15,000 pound anchorage point. Cable winch 56 may have a 2,000 pound pull capacity. And chain 64 may be grade 43, 5/16 thick, providing 3,900 pounds break strength. This example may be enough for two roofing installers 130 to fall at the same time, because 1,800 pounds per person may be required.

Support cable 114 may be included with fall protection cable system 10. See FIGS. 1-7. Support cable 114 may be for allowing roofing installer 130 a means to tie off to at elevated position 116 across roof 12 of steel building 14 from first side 18 to second side 74. Support cable 114 may thus be configured to be connected at elevated position 116 above roof 12 of steel building 14 between top starting end 22 of starting support post 16 attached to first side 18 of steel building 14 and top final end 78 of final support post 72 attached to second side 74 of steel building 14. Support cable 114 may be provided in various strengths and thicknesses depending on the size of steel building 14 and safety requirements. Fall protection cable system 10 may be configured where starting support post 16 and final support post 72 may be configured to position support cable 114 at elevated position 116 above roof 12, including but not limited to, an elevated position 116 of approximately 8 feet As such, the length of starting vertical member 30 and final vertical member 86 may be 8 feet or approximately 8 feet to provide elevated position 116 over roof 12 of support cable 114. As an example, and clearly not limited thereto, support cable 114 may be a 5/16 thick 6×37 IWRC, which may have 8,240 pounds of breaking strength. This example of support cable 114 may have enough strength for two roofing installers 130 to fall simultaneously, as required 1,800 pounds per person times a safety factor of 2 (1,800 pounds×2×2 people=7,200 pound requirement).

Figure 9:
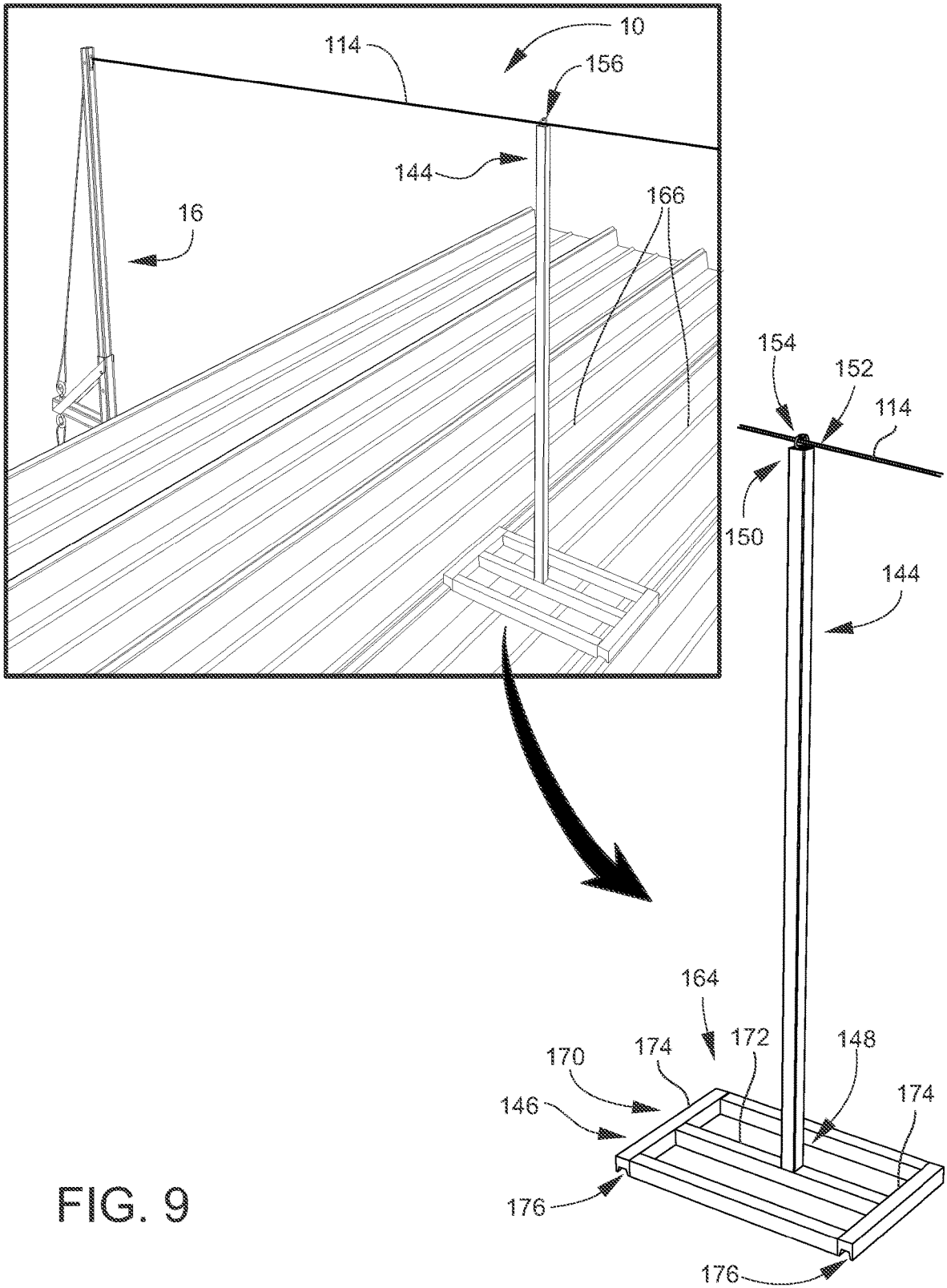
FIG. 9 is a perspective view of an intermediate support post of the fall protection cable system for roofing installation on steel buildings according to select embodiments of the instant disclosure with the panel base.

Referring now to FIGS. 1-2 and 9, in select embodiments of fall protection cable system 10, system 10 may further include at least one optional intermediate support post 144. The at least one intermediate support post or posts 144 may be positioned between starting support post 16 and final support post 72. As such, for short spans, intermediate support posts 144 may not be required. On the other hand, the further the distance or span between starting support post 16 and final support post 72, the more intermediate support posts 144 may be required. Each of the at least one intermediate support posts 144 may include base 146 and summit 150. Base 146 may be configured to be positioned on roof 12 of steel building 14 at one end 148 of intermediate support post 144. Summit 150 at other end 152 of intermediate support post 144 may be positioned at or approximate to elevated position 116 of support cable 114. Passage 154 at summit 150 of intermediate support post 144 may be configured for receiving support cable 114 therethrough or on top of. Passage 154 may support the support cable 114 at or approximate to elevated position 116 above roof 12 at support location 156 of intermediate support post 144, or multiple support locations 156 of multiple intermediate support posts 144. Support location 156 of each of the at least one intermediate support posts 144 may be positioned set distance 158 between starting support post 16 and final support post 72. As examples, and clearly not limited thereto, in select embodiments, set distance 158 may be, but is not limited to, between 50 feet and 150 feet.

Referring now to FIGS. 1-2, 5-7 and 9, in select embodiments, base 146 of each of the intermediate support posts 144 may be either rigid base 160 (as shown I FIGS. 1-2 and 5-7) or panel base 164 (as shown in FIG. 9). Rigid base 160 may be configured to attach intermediate support post 144 directly to roof beam 162 of steel building 14, as shown in FIGS. 5-7. Panel base 164 may be configured to attach or position intermediate support post 144 on top of roof panel 166 already installed on steel building 14. Wherein, intermediate support posts 144 may be configured to be changed from ones with rigid base 160 to ones with panel base 164 once roof panel 166 is installed on steel building 14 at support location 156 of the intermediate support post 144. In select embodiments, rigid base 160 may include bracket 168 configured for bolting base 146 to roof beam 162. In other select embodiments, panel base 164 of intermediate support post 144 may include I-shaped beam 170 with center beam 172 and two outer beams 174. Center beam 172 may be rigidly connected to base 146 of intermediate support post 144 (like via 5½" bolts). The two outer beams 174 may include channels 176 configured to be inserted over standing seams 178 of adjoining roof panels 166. The two outer beams 174 may thus be configured to be attached onto standing seam 178 of adjoining roof panels 166. In select embodiments, I-shaped beam 170 may be adjustable from 16" to 24" to fit the various size roofing panels 166. In select embodiments, each of the at least one intermediate support posts 144 may be hollow structural section steel posts 136. As an example, and clearly not limited thereto, each of the hollow structural section steel intermediate support posts 244 with rigid base 160 may have a length of 7' from base 146 to summit 150, a width of 2", and a depth of 2", where the hollow structural section steel final post 136 has a thickness of ¼". As another example, an clearly not limited thereto, each of the hollow structural section steel intermediate support posts 144 with panel base 164 may have a length of 6'8" from base 146 to summit 150, a width of 2", and a depth of 2", where the hollow structural section steel final post has a thickness of ¼". As an example, and clearly not limited thereto, each of the intermediate support posts 144 may be made from HSS 2×2×¼. In addition, each of these example intermediate support posts 144 with rigid base 160 may be fastened with (2) ¾" bolts. Every job may be different, but it may be preferred to keep set distance 158 to 50'.

As shown in FIGS. 5-7, fall protection cable system 10 may also include personal protective equipment 118. Personal protective equipment 118 may be configured for tying off roofing installer 130 to support cable 114. Personal protective equipment 118 may be any desired tie off equipment known or later developed. As examples, and clearly not limited thereto, in select embodiments, personal protective equipment may include, but is not limited to, harness 120, lanyard 122, and/or retractable lanyard 124, the like, or combinations thereof. As an example, and clearly not limited thereto, FFD=HD+LL—AE, where FFD=free fall distance, HD=height of D ring (5'), LL=lanyard length (lanyards we use allow 2'), AE=anchor to edge distance (cable 7' above working point), FFD=5+2−7=0 feet free fall. It may be preferred to plan for 5' of swag in cable, so FFD=5'. In addition, for CR=LL+EAD+HW+SM, where CR=clearance requirement, LL=lanyard length, EAD=energy absorber deployment, HW=height of worker, SM=safety margin, CR=2'+2.5'+6'+2'=12.5'

One feature of the disclosed fall protection cable system 10 may be that support cable 114 can be configured for allowing roofing installer 130 to tie off to support cable 114 at elevated position 116 above roof 12 during installation of roof 12. This may allow roofing installer 130, or multiple roofing installers 130 to move rather freely around on top of roof 12 during installation.

Figure 8:
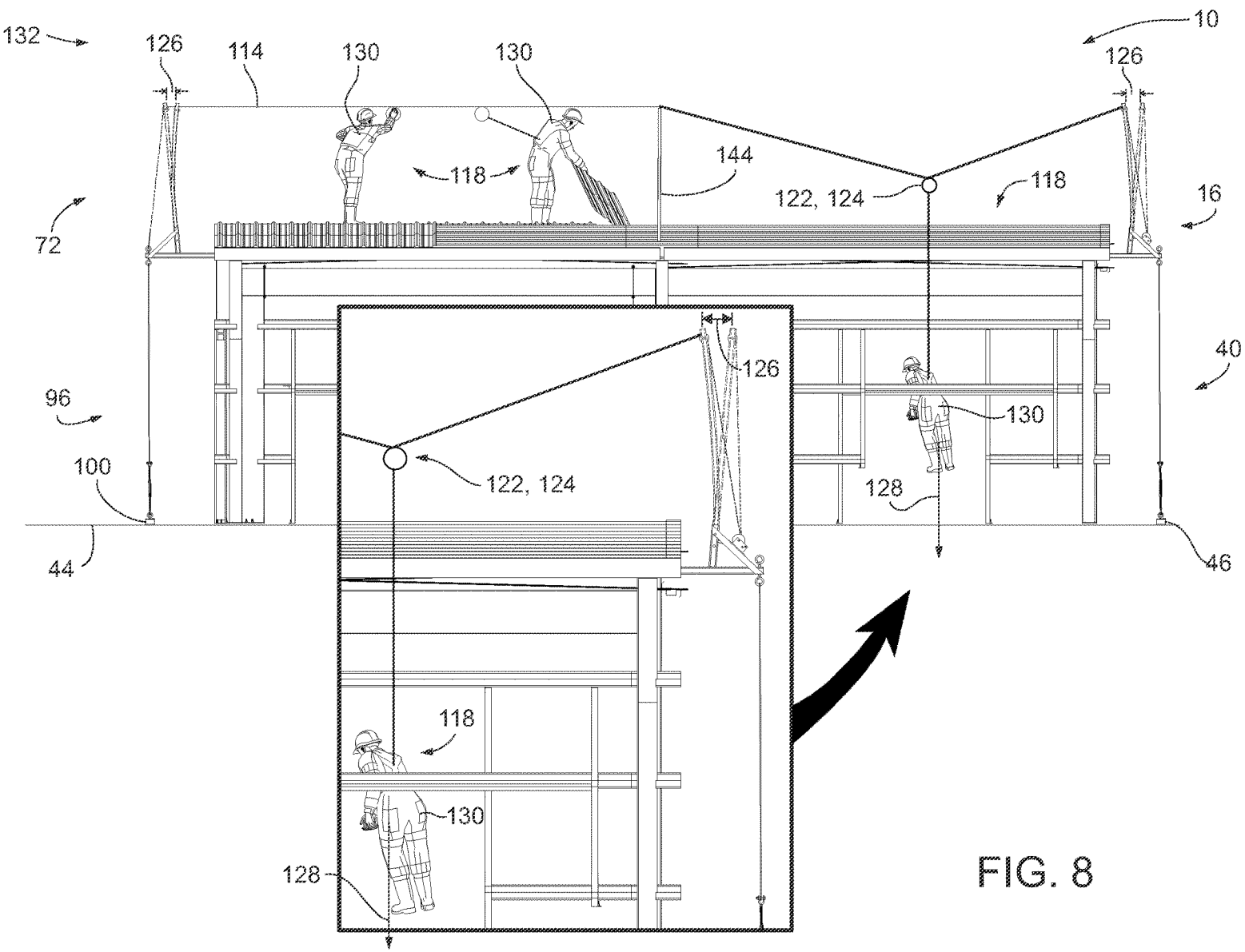
FIG. 8 is an environmental side view of the fall protection cable system for roofing installation on steel buildings according to select embodiments of the instant disclosure installed on a steel building in use showing the load when a roofing installer falls down and the spring deflection created by the combination of the starting vertical member and the final vertical member.

Referring now specifically to FIG. 8, another feature of the disclosed fall protection cable system 10 may be that spring deflection 126 can be created under load 128 of support cable 114, like when roofing installer 130 falls. Spring deflection 126 can be created by combination 132 of starting vertical member 30 and final vertical member 86 being oriented slightly past vertical from one another (via starting slightly obtuse angle 32 and final slightly obtuse angle 88), wherein starting vertical member 30 and final vertical member 86 are configured to bend toward each other under load 128 of support cable 114 when roofing installer 130 falls. Spring deflection 126 created by the bending of starting vertical member 30 and final vertical member 86 may be a function of the steel used in starting vertical member 30 and final vertical member 86, and thus may be adjusted or variable depending on the length, thickness, type of steel, etc. used in starting vertical member 30 and final vertical member 86.

Figure 10:
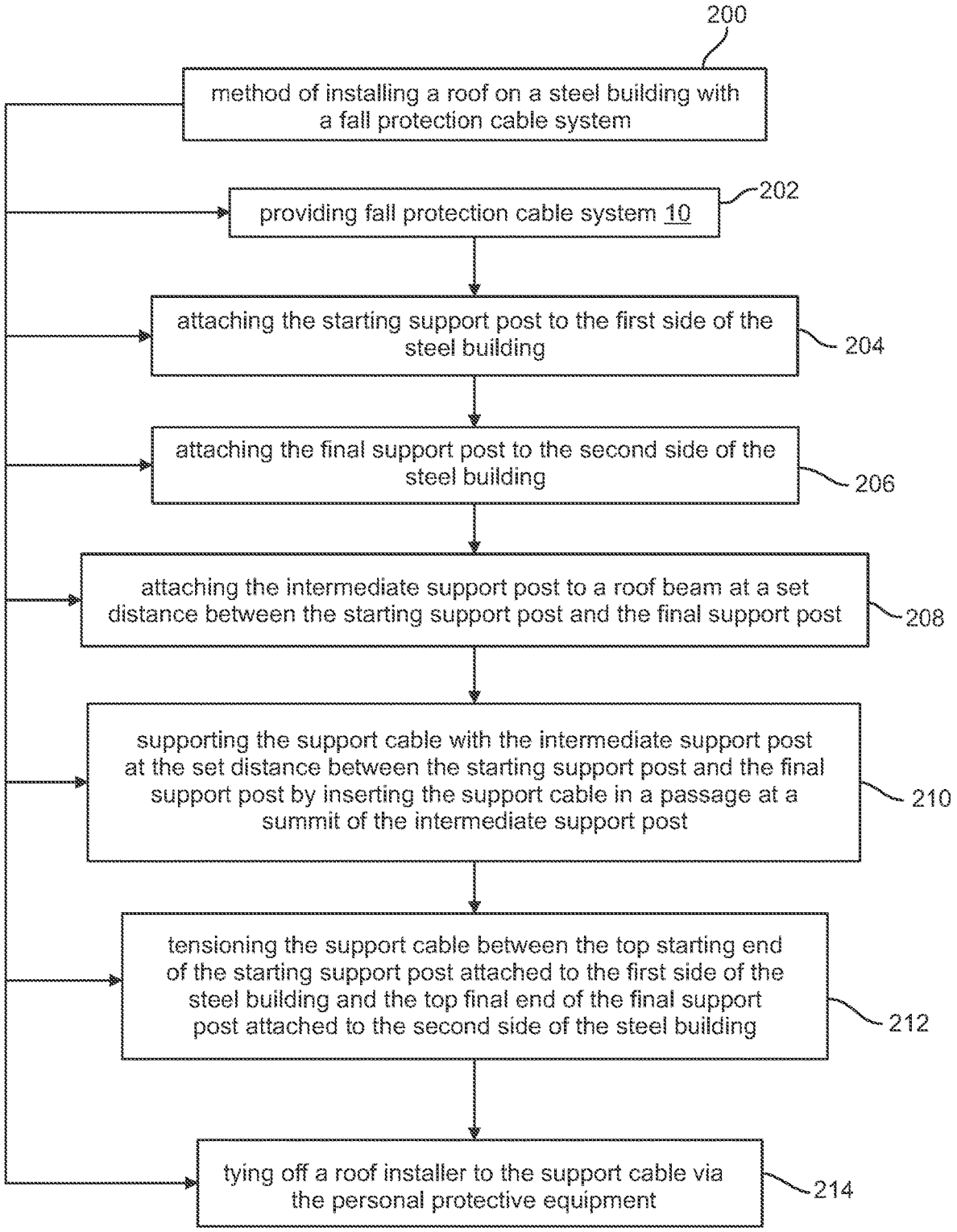
FIG. 10 is a flow chart of the method of installing a roof on a steel building with the disclosed fall protection cable system according to select embodiments of the instant disclosure.

Referring now specifically to FIG. 10, in another aspect, the instant disclosure embraces method 200 of installing roof 12 on steel building 14 while tying off with fall protection cable system 10. In general, method 200 of installing roof 12 on steel building 14 includes utilizing fall protection cable system 10 in any of the various embodiments shown and/or described herein. Accordingly, in select embodiments, method 200 of installing roof 12 on steel building 14 may include step 202 of providing fall protection cable system 10 in any of the various embodiments shown and/or described herein, including, but not limited to: starting support post 16 configured for attachment to first side 18 of steel building 14. The starting support post 16 may have bottom starting end 20 configured to attach to first side 18 of steel building 14 and top starting end 22 extending above roof 12 on first side 18 of steel building 14; final support post 72 configured for attachment to second side 74 of steel building 14, final support post 72 having bottom final end 76 configured to attach to second side 74 of steel building 14 and top final end 78 extending above roof 12 on second side 74 of steel building 14; support cable 114 configured to be connected at elevated position 116 above roof 12 of steel building 14 between top starting end 22 of starting support post 16 attached to first side 18 of steel building 14 and top final end 78 of final support post 72 attached to second side 74 of steel building 14; and personal protective equipment 118 configured for tying off the roofing installer 130 to support cable 114, personal protective equipment 118 including: harness 120; lanyard 122; and retractable lanyard 124. Method 200 of installing roof 12 on steel building 14 thus includes: step 204 of attaching starting support post 16 to first side 18 of steel building 14; step 206 of attaching final support post 72 to second side 74 of steel building 14; step 208 of tensioning support cable 114 between top starting end 22 of starting support post 16 attached to first side 18 of steel building 14 and top final end 78 of final support post 72 attached to second side 74 of steel building 14; and step 214 of tying off roof installer 130 to support cable 114 via personal protective equipment 118.

Still referring specifically to FIG. 10, in select embodiments of method 200 of installing roof 12 on steel building 14, wherein fall protection cable system 10 may further include intermediate support post 144, method 200 may further include: step 208 of attaching intermediate support post 144 to roof beam 162 at set distance 158 between starting support post 16 and final support post 72; and step 210 of supporting support cable 114 with intermediate support post 144 at set distance 158 between starting support post 16 and final support post 72 by inserting support cable 114 in 154 passage at summit 150 of intermediate support post 144.

In the specification and/or figures, typical embodiments of the disclosure have been disclosed. The present disclosure is not limited to such exemplary embodiments. The use of the term "and/or" includes any and all combinations of one or more of the associated listed items. The figures are schematic representations and so are not necessarily drawn to scale. Unless otherwise noted, specific terms have been used in a generic and descriptive sense and not for purposes of limitation.

The foregoing description and drawings comprise illustrative embodiments. Having thus described exemplary embodiments, it should be noted by those skilled in the art that the within disclosures are exemplary only, and that various other alternatives, adaptations, and modifications may be made within the scope of the present disclosure. Merely listing or numbering the steps of a method in a certain order does not constitute any limitation on the order of the steps of that method. Many modifications and other embodiments will come to mind to one skilled in the art to which this disclosure pertains having the benefit of the teachings presented in the foregoing descriptions and the associated drawings. Although specific terms may be employed herein, they are used in a generic and descriptive sense only and not for purposes of limitation. Accordingly, the present disclosure is not limited to the specific embodiments illustrated herein, but is limited only by the following claims.

The invention claimed is:

1. A fall protection cable system configured for installation of a roof on a steel building comprising:

a starting support post configured for attachment to a first side of the steel building, said starting support post having a bottom starting end configured to attach to the first side of the steel building and a top starting end extending above the roof on the first side of the steel building, the starting support post including:

a starting horizontal member with a starting plate at one end configured for attachment to the steel building;

a starting vertical member rigidly attached to the starting horizontal member and extending upward therefrom, where the starting vertical member extends at a starting slightly obtuse angle from the end of the starting horizontal member with the starting plate, whereby the starting vertical member is oriented slightly past vertical from the end of the starting horizontal member with the starting plate;

a starting ground anchor connected from an another end of the starting horizontal member to ground via a starting concrete anchor plate affixed thereto, where the starting ground anchor is connected to the another end of the starting horizontal member via a first eyebolt, and is connected to the starting concrete anchor via a starting turnbuckle cable connection configured for tensioning the starting ground anchor between the another end of the starting horizontal member and the ground;

a final support post configured for attachment to a second side of the steel building, said final support post having a bottom final end configured to attach to the second side of the steel building and a top final end extending above the roof on the second side of the steel building, the final support post including:

a final horizontal member with a final plate at one end configured for attachment to the steel building;

a final vertical member rigidly attached to the final horizontal member and extending upward therefrom, where the final vertical member extends at a final slightly obtuse angle from the end of the final horizontal member with the final plate, whereby the final vertical member is oriented slightly past vertical from the end of the final horizontal member with the final plate;

a final ground anchor connected from an another end of the final horizontal member to the ground via a final concrete anchor plate affixed thereto, where the final ground anchor is connected to the another end of the final horizontal member via a third eyebolt, and is connected to the final concrete anchor via a final turnbuckle cable connection configured for tensioning the final ground anchor between the another end of the final horizontal member and the ground;

a support cable configured to be connected at an elevated position above the roof of the steel building between the top starting end of the starting support post attached to the first side of the steel building and the top final end of the final support post attached to the second side of the steel building.

2. The fall protection cable system according to claim 1, wherein the support cable is configured for allowing a roofing installer to tie off to the support cable at the elevated position above the roof during installation of the roof.

3. The fall protection cable system according to claim 1, wherein a spring deflection is created under a load of the support cable when a roofing installer falls by a combination of the starting vertical member and the final vertical member being oriented slightly past vertical from one another, wherein the starting vertical member and the final vertical member are configured to bend toward each other under the load of the support cable when the roofing installer falls.

4. The fall protection cable system according to claim 1, wherein:

the starting vertical member is a 2-piece starting vertical member having a base starting vertical member and a telescoping starting vertical member configured to be inserted into the base starting vertical member for use in the fall protection cable system and to be removed from the base starting vertical member for transportation;

the final vertical member is a 2-piece final vertical member having a base final vertical member and a telescoping final vertical member configured to be inserted into the base final vertical member for use in the fall protection cable system and to be removed from the base final vertical member for transportation.

5. The fall protection cable system according to claim 1, wherein:

the starting support post further including:

a starting angled support member rigidly connected between the starting vertical member at a first support location and the starting horizontal member at the another end of the starting horizontal member opposite of the starting plate, the starting angled support member is configured to support the starting vertical member under a load of the support cable; and the final support post further including:

a final angled support member rigidly connected between the final vertical member at second support location and the final horizontal member at the another end of the final horizontal member opposite of the final plate, the final angled support member is configured to support the final vertical member under the load of the support cable.

6. The fall protection cable system according to claim 5, wherein:

the starting support post further includes:

a cable winch positioned on the starting angle support and connected to a first end of the support cable, the cable winch being configured for creating a desired tension in the support cable between the starting support post and the final support post;

a pulley at the top starting end of the starting support post configured to position the support cable at the top starting end of the starting support post while allowing the support cable to roll over the top starting end of the starting support post while being tensioned by the winch; and a chain configured to connect the first end of the support cable to the another end of the starting horizontal member for removing the cable winch from the forces of the support cable, said chain including an S-link at one end for removable connection to the first end of the support cable and being connected to the another end of the starting horizontal member via a second eyebolt; and the final support post includes:

a fourth eyebolt attached to the top final end of the final support post, the fourth eyebolt is configured to connect to a second end of the support cable for fixing the support cable to the top final end of the final support post.

7. The fall protection cable system according to any one of claim 6, wherein, the final support post further includes:

a shock absorber connected between the fourth eyebolt and the second end of the support cable configured to absorb shock created in the support cable when under the load in the support cable from a roofing installer falling.

8. The fall protection cable system according to claim 1, wherein the starting support post and the final support post are constructed from hollow structural section steel posts.

9. The fall protection cable system according to claim 8, wherein the hollow structural section steel posts of the starting support post and the final support post have a width of 2.5", a depth of 2.5", and a thickness of ¼".

10. The fall protection cable system according to claim 1, wherein the starting support post and the final support post are configured to position the support cable at the elevated position above the roof of approximately 8 feet.

11. The fall protection cable system according to claim 1 further comprising at least one intermediate support post positioned between the starting support post and the final support post, each of the at least one intermediate support posts includes:

a base configured to be positioned on the roof of the steel building at one end of the intermediate support post;

a summit at the other end of the intermediate support post positioned at or approximate to the elevated position of the support cable; and a passage at the summit of the intermediate support post configured for receiving the support cable therethrough, the passage supporting the support cable at the elevated position above the roof at a support location of the intermediate support post.

12. The fall protection cable system according to claim 11, wherein the support location of each of the at least one intermediate support post is positioned a set distance between the starting support post and the final support post, wherein the set distance is between 50 feet and 150 feet.

13. The fall protection cable system according to claim 11, wherein the base of each of the intermediate support posts is either:

a rigid base configured to attach the intermediate support post directly to a roof beam of the steel building; or a panel base configured to attach the intermediate support post on top of a roof panel already installed on the steel building;

wherein the intermediate support posts are configured to be changed from the rigid base to the panel base once the roof panel is installed on the steel building at the support location of the intermediate support post.

14. The fall protection cable system according to claim 13, wherein:

the rigid base includes a bracket configured for bolting the base to the roof beam; and the panel base of the intermediate support post includes an I-shaped beam with a center beam and two outer beams, where the center beam is rigidly connected to the base of the intermediate support post, and the two outer beams include channels configured to be inserted over standing seams of adjoining roof panels, where the two outer beams are configured to be rigidly attached to the standing seam of adjoining roof panels, where the I-shaped beam is adjustable from 16" to 24" roofing panels.

15. The fall protection cable system according claim 1 further comprising personal protective equipment configured for tying off a roofing installer to the support cable, the personal protective equipment including:

a harness;

a lanyard; and a retractable lanyard.

16. A fall protection cable system configured for installation of a roof on a steel building comprising:

a starting support post configured for attachment to a first side of the steel building, said starting support post having a bottom starting end configured to attach to the first side of the steel building and a top starting end extending above the roof on the first side of the steel building, the starting support post including:

a starting horizontal member with a starting plate at one end configured for attachment to the steel building;

a starting vertical member rigidly attached to the starting horizontal member and extending upward therefrom, where the starting vertical member extends at a starting slightly obtuse angle from the end of the starting horizontal member with the starting plate, whereby the starting vertical member is oriented slightly past vertical from the end of the starting horizontal member with the starting plate, the starting vertical member is a 2-piece starting vertical member having a base starting vertical member and a telescoping starting vertical member configured to be inserted into the base starting vertical member for use in the fall protection cable system and to be removed from the base starting vertical member for transportation;

a starting ground anchor connected from another end of the starting horizontal member to ground via a starting concrete anchor plate affixed thereto, where the starting ground anchor is connected to the another end of the starting horizontal member via a first eyebolt, and is connected to the starting concrete anchor via a starting turnbuckle cable connection configured for tensioning the starting ground anchor between the another end of the starting horizontal member and the ground;

a starting angled support member rigidly connected between the starting vertical member at a first support location and the starting horizontal member at the another end of the starting horizontal member opposite of the starting plate, the starting angled support member is configured to support the starting vertical member under load of a support cable;

a cable winch positioned on the starting angle support and connected to a first end of the support cable, the cable winch being configured for creating a desired tension in the support cable between the starting support post and the final support post;

a pulley at the top starting end of the starting support post configured to position the support cable at the top starting end of the starting support post while allowing the support cable to roll over the top starting end of the starting support post while being tensioned by the winch; and a chain configured to connect the first end of the support cable to the another end of the starting horizontal member for removing the cable winch from the forces of the support cable, said chain including an S-link at one end for removable connection to the first end of the support cable and being connected to the another end of the starting horizontal member via a second eyebolt;

a final support post configured for attachment to a second side of the steel building, said final support post having a bottom final end configured to attach to the second side of the steel building and a top final end extending above the roof on the second side of the steel building, the final support post including:

a final horizontal member with a final plate at one end configured for attachment to the steel building;

a final vertical member rigidly attached to the final horizontal member and extending upward therefrom, where the final vertical member extends at a final slightly obtuse angle from the end of the final horizontal member with the final plate, whereby the final vertical member is oriented slightly past vertical from the end of the final horizontal member with the final plate, the final vertical member is a 2-piece final vertical member having a base final vertical member and a telescoping final vertical member configured to be inserted into the base final vertical member for use in the fall protection cable system and to be removed from the base final vertical member for transportation;

a final ground anchor connected from another end of the final horizontal member to the ground via a final concrete anchor plate affixed thereto, where the final ground anchor is connected to the another end of the final horizontal member via a third eyebolt, and is connected to the final concrete anchor via a final turnbuckle cable connection configured for tensioning the final ground anchor between the another end of the final horizontal member and the ground;

a final angled support member rigidly connected between the final vertical member at a second support location and the final horizontal member at the another end of the final horizontal member opposite of the final plate, the final angled support member is configured to support the final vertical member under load of the support cable; and a fourth eyebolt attached to the top final end of the final support post, the fourth eyebolt is configured to connect to a second end of the support cable for fixing the support cable to the top final end of the final support post; and the support cable is configured to be connected at an elevated position above the roof of the steel building between the top starting end of the starting support post attached to the first side of the steel building and the top final end of the final support post attached to the second side of the steel building; and personal protective equipment configured for tying off the roofing installer to the support cable, the personal protective equipment including:

a harness;

a lanyard; and a retractable lanyard;

wherein the support cable is configured for allowing a roofing installer to tie off to the support cable at the elevated position above the roof during installation of the roof;

wherein a spring deflection is created under a load of the support cable when a roofing installer falls by a combination of the starting vertical member and the final vertical member being oriented slightly past vertical from one another, wherein the starting vertical member and the final vertical member are configured to bend toward each other under the load of the support cable when the roofing installer falls.

17. A fall protection cable system configured for installation of a roof on a steel building comprising:

a starting support post configured for attachment to a first side of the steel building, said starting support post having a bottom starting end configured to attach to the first side of the steel building and a top starting end extending above the roof on the first side of the steel building;

a final support post configured for attachment to a second side of the steel building, said final support post having a bottom final end configured to attach to the second side of the steel building and a top final end extending above the roof on the second side of the steel building;

a support cable configured to be connected at an elevated position above the roof of the steel building between the top starting end of the starting support post attached to the first side of the steel building and the top final end of the final support post attached to the second side of the steel building; and at least one intermediate support post positioned between the starting support post and the final support post, each of the at least one intermediate support posts includes:

a base configured to be positioned on the roof of the steel building at one end of the intermediate support post;

a summit at the other end of the intermediate support post positioned at or approximate to the elevated position of the support cable; and a passage at the summit of the intermediate support post configured for receiving the support cable therethrough, the passage supporting the support cable at the elevated position above the roof at a support location of the intermediate support post;

wherein the base of each of the intermediate support posts is either:

a rigid base configured to attach the intermediate support post directly to a roof beam of the steel building; or a panel base configured to attach the intermediate support post on top of a roof panel already installed on the steel building;

wherein the intermediate support posts are configured to be changed from the rigid base to the panel base once the roof panel is installed on the steel building at the support location of the intermediate support post.

* * * * *